United States Patent [19]

Petrik

[11] Patent Number: 4,782,608

[45] Date of Patent: Nov. 8, 1988

[54] VARIABLE STEAM CONTROL FOR ELECTRIC IRON

[75] Inventor: John Petrik, Newtown, Conn.

[73] Assignee: Black & Decker, Inc., Newark, Del.

[21] Appl. No.: 928,319

[22] Filed: Nov. 7, 1986

[51] Int. Cl.[4] ..... D06F 75/18

[52] U.S. Cl. ..... 38/77.83; 29/428; 38/77.7; 74/57; 251/122

[58] Field of Search ..... 38/77.83, 77.7, 77.8; 74/57, 568; 251/122; 29/157 R, 428

[56] References Cited

U.S. PATENT DOCUMENTS

| | | | |
|---|---|---|---|
| D. 34,659 | 6/1901 | Schmick | 74/568 |
| 1,929,973 | 10/1933 | Haley | 251/122 X |
| 2,506,941 | 5/1950 | Scott | 38/77.82 |
| 3,165,843 | 1/1965 | Willman | 38/77.83 |
| 3,263,350 | 8/1966 | Abraham | 38/77.7 |
| 3,308,852 | 3/1967 | Parker et al. | 251/122 X |
| 3,896,572 | 7/1975 | Jeffress | 38/77.83 |
| 4,070,773 | 1/1978 | Gowdy | 38/77.83 |
| 4,125,953 | 11/1978 | Colombo | 38/77.83 X |
| 4,627,181 | 12/1986 | Bastida | 38/77.7 |
| 4,677,774 | 7/1987 | Macchi | 38/77.7 X |

FOREIGN PATENT DOCUMENTS

| | | | |
|---|---|---|---|
| 350520 | 1/1961 | Switzerland | 251/122 |
| 2146413 | 4/1985 | United Kingdom | 251/122 |

*Primary Examiner*—Andrew M. Falik

*Attorney, Agent, or Firm*—Paul J. Lerner

[57] ABSTRACT

A variable steam control for a steam iron employs a metering rod having a plurality of cylindrical portions of successively decreasing diameters. A cam controls the position of the metering rod to position a selectable one of the cylindrical portions within a circular opening, whereby controllable water flow rates, and consequent steam flow rates are attained. The cam includes an assembly region having a cam-installation opening therein, usable following drop-in assembly, for enabling a head of a steam-control actuator rod to pass through the cam. A one-time movement of the cam locks the head in one of a plurality of user regions and blocks return to the assembly region.

6 Claims, 4 Drawing Sheets

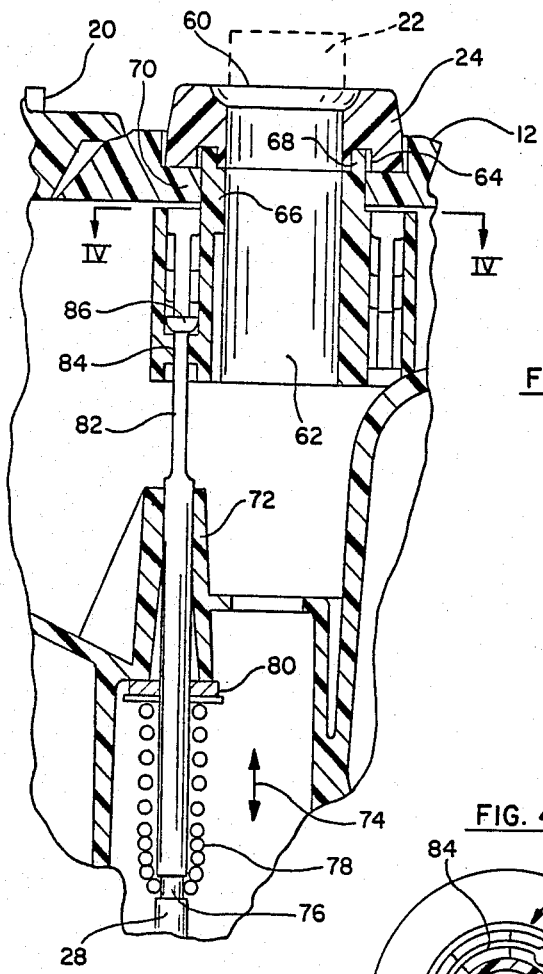
FIG. 3
FIG. 4
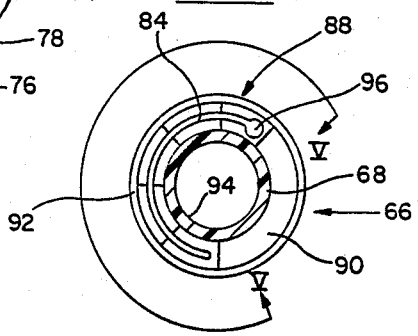

VARIABLE STEAM CONTROL FOR ELECTRIC IRON

BACKGROUND OF THE INVENTION

The present invention relates to electric irons and, more particularly, to controlling delivery of water to a steam generator in an electric iron.

Modern electric irons are distinguished by apparatus for producing a supply of steam contacting a fabric material being smoothed. The iron includes a heated sole plate and an internal water reservoir. Water from the water reservoir is metered at a predetermined flow rate into contact with an internal heated surface of the sole plate. The water turns to steam upon contact with the sole plate. The steam flows through apertures in the sole plate into contact with the fabric.

Metering of water from the reservoir to the sole plate is conventionally controlled by a metering rod providing a predetermined annular space between itself and a metering aperture. A seal surrounding the metering rod is lowered into a sealing condition about the perimeter of the metering aperture by a suitable cam arrangement.

The prior art steam-control apparatus described above produces a single water-delivery rate and is thus limited to the generation of steam at a corresponding single rate. The ability to vary the rate of steam generation may be desirable for accommodating different fabric weights and types. The above prior-art devices are incapable of providing such variable steam generation.

Modern appliances rely on the design of the device for aiding the assembly process. In an electric iron requiring cam actuation of an actuating rod, a problem exists in providing drop-in assembly of the cam onto the actuating rod. This problem is compounded in an appliance having an actuating cam with a plurality of land levels for controlling a plurality of water metering rates to the sole plate of an electric iron.

OBJECTS AND SUMMARY OF THE INVENTION

It is an object of the invention to provide an electric iron having a selectable plurality of water flow rates for steam generation.

It is a further object of the invention to provide an electric iron having a water metering valve including a metering rod having at least two diameters and a metering aperture operative, together with the metering rod, for controlling a flow of water to a sole plate of the electric iron. A cam positions the metering rod at one of a plurality of axial positions for controlling the rate of water delivery to the sole plate and the consequent rate of steam generation.

It is a further object of the invention to provide a cam for actuating an actuating rod wherein the cam includes an assembly position permitting drop-in assembly thereof and at least two user positions. The cam is actuable a single time from the manufacturing to one of the user positions and is thereafter incapable of returning to the assembly position.

Briefly stated, the present invention provides a variable steam control for a steam iron employing a metering rod having a plurality of cylindrical portions of successively decreasing diameters. A cam controls the position of the metering rod to position a selectable one of the cylindrical portions within a circular opening, whereby controllable water flow rates, and consequent steam flow rates are attained. The cam includes an assembly region having a cam-installation opening therein, usable following drop-in assembly, for enabling a head of a steam-control actuator rod to pass through the cam. A one-time movement of the cam locks the head in one of a plurality of user regions and blocks return to the assembly region.

According to an embodiment of the invention, there is provided a variable steam control for an electric iron, the electric iron including a water reservoir and a heatable steam chamber, comprising: a tap-water valve communicable with water in the water reservoir, a metering rod passing through an opening in the tap-water valve, a water channel from the tap-water valve to the steam chamber, the metering rod including at least first and second portions having first and second different cross-sectional dimensions, respectively, the opening having a third cross-sectional dimension, the third cross-sectional dimension being larger than the first and the second cross-sectional dimensions, and means for selectively positioning one of the at least first and second portions in the opening whereby at least first and second different water flow rates into the steam chamber are provided.

According to a feature of the invention, there is provided apparatus for permitting assembly of a metering rod to a cam comprising: an assembly region and at least two user regions on the cam, an opening in the assembly region through the cam, a head on the metering rod, the opening being sized to permit passage of the head therethrough, a ramp in the assembly region leading to the at least two user regions, means for permitting the cam to move relative to the head whereby one of the at least two user regions contains the head, and means for blocking the head from returning to the assembly region.

According to a further feature of the invention, there is provided a method for assembly a metering rod to a cam, the cam having an assembly region and at least two user regions, comprising: passing the head through an opening in the assembly region, sliding the head up a ramp in the assembly region leading to the at least two user regions, and blocking the head from returning to the assembly region.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3 is a cross section of a steam-control cam knob and cylindrical cam of the embodiment of the invention in FIG. 2.

FIG. 4 is a cross section taken along IV—IV in FIG. 3.

DETAILED DESCRIPTION OF THE PREFERRED EMBODIMENT

Figure 1:
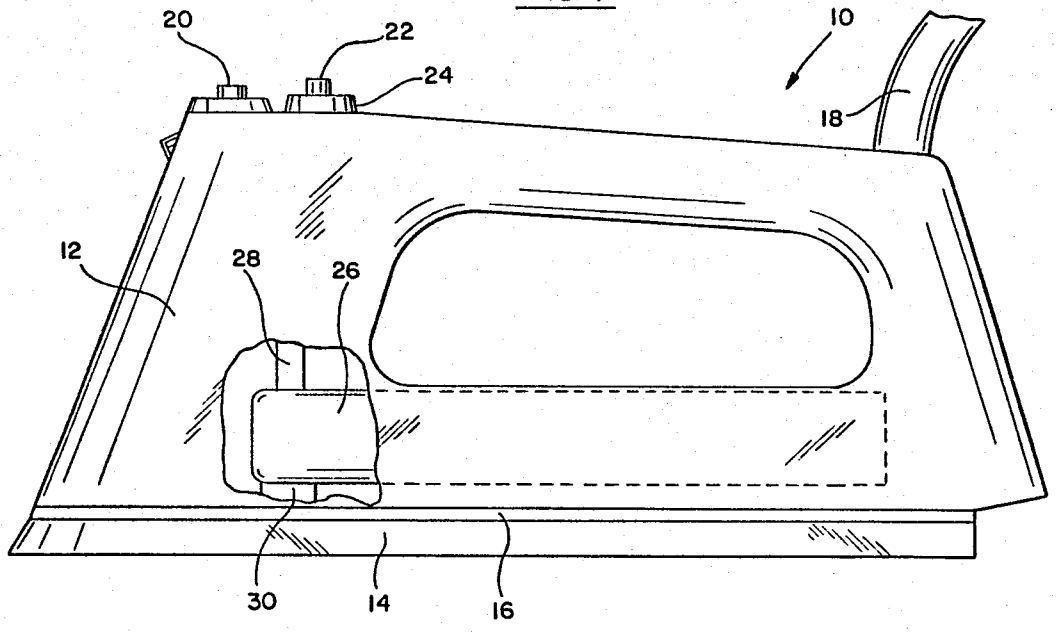
FIG. 1 is a side view of an electric iron according to an embodiment of the invention partly cut away to reveal a steam-control valve.

Referring now to FIG. 1, there is shown, generally at 10, an electric iron according to an embodiment of the invention. A housing 12 is affixed to a sole plate 14 by any convenient means (not shown). Housing 12 is conventionally of polypropylene or other plastic unable to withstand, without melting, the temperatures at which sole plate 14 is operated. A heat barrier 16 of a heat-resistant material such as, for example, a phenolic plastic, is interposed between sole plate 14 and housing 12. Electric power is fed to a heating element (not shown) in thermal contact with sole plate 14 through a flexible electric cord 18.

Electric iron 10 includes several controls (some of which are not shown) including a temperature control 20, a water spray pump button 22 and a steam-control cam knob 24. A water reservoir 26 is disposed within housing 12. A steam-control actuator rod 28, interacting with steam-control cam knob 24 in a manner to be described hereinafter, enters water reservoir 26 from above. A steam-control valve 30 is aligned with steam-control actuator rod 28 between water reservoir 26 and sole plate 14.

The present invention is principally concerned with steam-control cam knob 24, water reservoir 26 and steam-control valve 30. The remaining elements in electric iron 10, although defining the environment within which the items of interest are contained, are assumed to be conventional and their description would not add to the present teaching. Thus, description of such assumed conventional elements is omitted.

Figure 2:
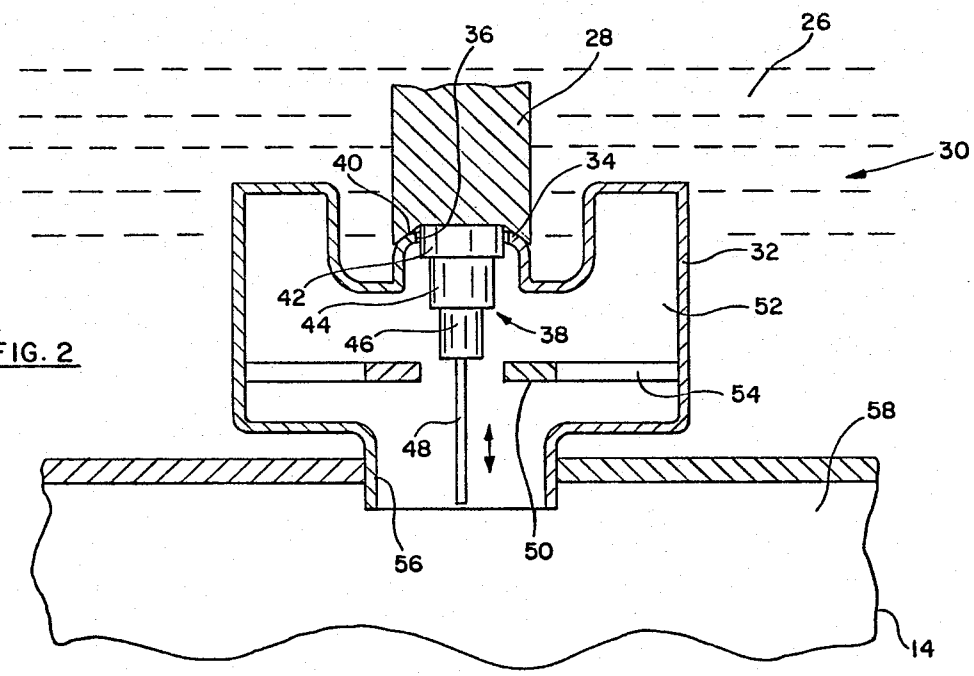
FIG. 2 is a cross section of the steam-control valve of FIG. 1.

Referring now to FIG. 2, steam-control valve 30 includes a tap-water valve 32 having a dome-shaped seal 34 with a circular opening 36 centered in its upper surface. A metering rod 38, axially affixed to a lower end of steam-control actuator rod 28, passes through circular opening 36. An inverted conical sealing surface 40 sealingly engages an upper surface of dome-shaped seal 34 when steam-control valve 30 is in the sealing position illustrated in the figure.

Metering rod 38 includes a plurality such as, for example, four cylindrical portions 42, 44, 46 and 48 having successively smaller diameter axially aligned therewith. A scraper plate 50 is optionally contained within an interior 52 of tap-water valve 32 for removing scale, or other contaminants, from cylindrical portion 48. Openings 54, of relatively large size, permit substantially free communication of water between upper and lower surfaces of scraper plate 50. A water channel 56 leads to a steam chamber 58 within sole plate 14 from whence steam generated by water passing through steam-control valve 30 and contacting a heated surface in sole plate 14 is distributed through openings (not shown) to a fabric (not shown) being smoothed.

Steam-control valve 30 is actuated by raising steam-control actuator rod 28 a predetermined distance to position a selected one of cylindrical portions 42–48, aligned within circular opening 36. Each diameter of cylindrical portions 42–48 creates an annular gap between itself and circular opening 36 having an area equal to the difference between its cross-sectional area and the area of circular opening 36. Although different applications may require different dimensions, in one embodiment, circular opening 36 has a diameter of 0.038 inch and cylindrical portions 42–48 have diameters of 0.035, 0.034, 0.30, and 0.28 inch, respectively.

Referring now to FIG. 3, steam-control cam knob 24 includes an aperture 60 into which water spray pump button 22 is fitted. Water spray pump button 22 is not of concern to the present invention and its location is indicated in dashed lines. In addition, a volume 62 is provided for containing a water spray pump (not shown) actuated by water spray pump button 22, but the apparatus fitting into volume 62 is omitted to reduce clutter in the drawing.

Steam-control cam knob 24 includes an annular groove 64 in its underside. A cylindrical cam 66 includes an annular flange 68 extending from its upper edge into engagement with annular groove 64. Annular groove 64 and annular flange 68 are preferably bonded or welded together during preassembly of housing 12 to capture a flange 70 of housing 12 between them.

A guide 72 guides vertical displacement of steam-control actuator rod 28 as indicated by a double-headed arrow 74. An annular groove 76 engages a lower end of a resilient member such as, for example, a coil spring 78. An upper end of coil spring 78 bears against a washer 80 in contact with a lower surface of guide 72. A small-diameter portion 82 of steam-control actuator rod 28 passes through a part-annular slot 84 in cylindrical cam 66. An enlarged head 86 crowns an upper end of steam control actuator rod 28.

Referring now also to FIG. 4, cylindrical cam 66 includes a cam portion 88 subtending substantially more than 180 degrees and a solid portion 90 subtending the remainder of the circumference of cylindrical cam 66. Cam portion 88 is enclosed between an outer wall 92 and an inner wall 94. Part-annular slot 84, radially centered in cam portion 88, includes a cam-installation opening 96 at one end thereof.

Figure 5:
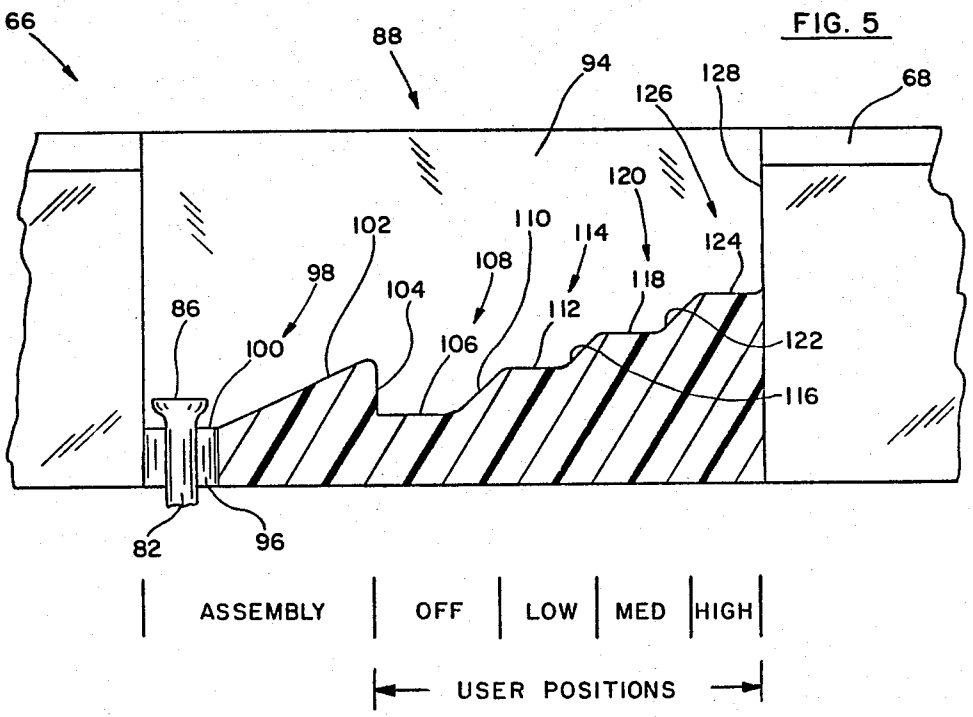
FIG. 5 is a developed view of the cylindrical cam of FIG. 4 taken in the direction V—V.

Referring now also to FIG. 5 (together with FIGS. 3 and 4), representing cylindrical cam 66 developed, or flattened out, cam portion 88 includes five discrete angular regions, represented as lengths in the developed view. An assembly region 98 includes a land 100, generally coextensive with cam-installation opening 96, and a ramp 102. The upper extremity of ramp 102 is halted at a blocking wall 104 which falls off substantially vertically to a land 106 of an OFF region 108. A ramp 110 of OFF region 108 leads upward to join a land 112 of a LOW region 114. A ramp 116 of land 112 leads upward to join a land 118 of a MED region 120. Finally, a ramp 122 of MED region 120 leads upward to join a land 124 of a HIGH region 126. A vertical wall 128 blocks the extremity of HIGH region 126.

In FIG. 3, manufacturing assembly is conveniently arranged to prepare steam-control cam knob 24 and cylindrical cam 66 in one subassembly and the elements including enlarged head 86, small-diameter portion 82 and below in a second subassembly. The embodiment of the invention illustrated permits drop-in assembly of these elements without separate final assembly of cylindrical cam 66 to enlarged head 86 and steam-control actuator rod 28. Specifically, the upper elements are positioned over the lower elements with steam-control cam knob 24 turned to align cam-installation opening 96 over enlarged head 86. The upper elements are then dropped into position with enlarged head 86 moving to the position shown in FIG. 5. Downward travel of enlarged head 86 is limited by the seat between inverted conical sealing surface 40 and dome-shaped seal 34 (FIG. 2), and thus enlarged head 86 extends slightly above land 100. Assembly is completed by rotating steam-control cam knob 24, with cylindrical cam 66 affixed thereto, until enlarged head 86 rides up ramp 102 against the opposed urging of coil spring 78 (FIG. 3) until enlarged head 86 drops over blocking wall 104 into the vicinity of, or in light contact with, land 106. In this position, steam-control valve 30 remains closed. As cylindrical cam 66 is rotated to positions wherein enlarged head 86 contacts lands of regions 114, 120 and 126, steam-control actuator rod 28 (FIG. 2) is raised to successively position cylindrical portions 44, 46 and 48, respectively, within circular opening 36. Thus, the successive positions of steam-control cam knob 24 and cylindrical cam 66 create successively greater clearances between circular opening 36 and metering rod 38. As a result, successively greater water flow rates are metered through steam-control valve 30 into steam chamber 58 and correspondingly greater steam flow rates are delivered to a fabric being smoothed.

It will be noted that, except for land 100, each land has a slight downward slope toward its ramp (FIG. 5). This provides a stable position for enlarged head 86 at each of the user positions.

Once cylindrical cam 66 is turned from assembly region 98 to the user positions, blocking wall 104 blocks return of enlarged head 86 to assembly region 98. Thus, assembly region 98 is a single-use position enabling a simple assembly operation which, once cylindrical cam 66 is turned to the user positions, is never again required. Similarly, vertical wall 128 blocks travel of enlarged head 86 beyond HIGH region 126.

Although the embodiment of the invention illustrated and described above employs a rotatable cam, on skilled in the art would recognize that corresponding results in assembly and operation are attainable using a linearly movable cam assembly. Such a linearly movable cam assembly should be considered to be within the scope of the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A variable steam control for an electric iron, said electric iron including a water reservoir and a heatable steam chamber, comprising:

a tap-water valve communicable with water in said water reservoir;

a metering rod passing through an opening in said tap-water valve;

a water channel from said tap-water valve to said heatable steam chamber;

said metering rod including at least first and second generally cylindrical portions having first and second different cross-sectional dimensions, respectively;

said opening having a minimum third cross-sectional dimension;

said third cross-sectional dimension being larger than said first and second cross-sectional dimensions;

means for selectively positioning one of said at least first and second dimensions in said minimum dimension, whereby at least first and second different water flow rates into said heatable chamber are provided;

said means for selectively positioning includes:

a steam-control actuator rod;

a cam having at least first and second lands joined by a ramp;

engagement means on said steam-control actuator rod for contacting said at least first and second lands and said ramp; and means for permitting said cam to be moved with respect to said engagement means, whereby said steam-control actuator rod is displaced to attain said selective positioning.

2. A variable steam control according to claim 1 wherein said cam is a rotatable cam and said engagement means is a head on said steam-control actuator rod.

3. A variable steam control according to claim 2 wherein said head is disposed, in its operative position, at surfaces of said cam remote from said tap-water valve.

4. A variable steam control according to claim 2 wherein said cam includes:

an assembly region and at least first and second user positions;

said assembly region including a third land and a second ramp;

a cam-installation opening in said assembly region passing through said third land;

said cam-installation opening permitting said head to pass therethrough;

means for permitting said cam to be moved from said assembly position to one of said at least first and second user positions; and means for blocking a return of said cam to said assembly position.

5. A metering rod and a cam, in combination, comprising:

an assembly region and at least two user regions on said cam;

an opening in said assembly region through said cam;

a head on said metering rod;

said opening being sized to permit passage of said head therethrough;

a ramp in said assembly region leading to said at least two user regions;

means for permitting said cam to move relative to said head whereby one of said at least two user regions contains said head; and means for blocking said head from returning to said assembly region.

6. A method for assembling a metering rod to a cam, said cam having an assembly region and at least two user regions, said metering rod including a head thereon, comprising:

passing said head through an opening in said assembly region;

sliding said head up a ramp in said assembly region leading to said at least two user regions; and blocking said head from returning to said assembly region.

* * * * *